US007458127B2

(12) United States Patent
Bruno et al.

(10) Patent No.: US 7,458,127 B2
(45) Date of Patent: Dec. 2, 2008

(54) TAPING KNIFE WITH OFFSET HANDLE

(75) Inventors: Robert Bruno, Avon, CT (US); Frank Sterpka, West Hartford, CT (US); Matthew Earle Myers, Naperville, IL (US)

(73) Assignee: United States Gypsum Company, Chicago, IL (US)

( * ) Notice: Subject to any disclaimer, the term of this patent is extended or adjusted under 35 U.S.C. 154(b) by 218 days.

(21) Appl. No.: 11/187,569

(22) Filed: Jul. 22, 2005

(65) Prior Publication Data

US 2007/0017052 A1 Jan. 25, 2007

(51) Int. Cl.
*E04F 21/16* (2006.01)

(52) U.S. Cl. ..... 15/235.4; 15/143.1; 15/236.01; 30/169; D8/45; D32/49

(58) Field of Classification Search ..... 15/143.1, 15/235.4, 236.01, 245.1; 30/169; D8/45; D32/46, 49

See application file for complete search history.

(56) References Cited

U.S. PATENT DOCUMENTS

| | | | | | |
|---|---|---|---|---|---|
| D167,775 | S | * | 9/1952 | Schmidt | D4/132 |
| D206,517 | S | | 12/1966 | Han | |
| D307,862 | S | * | 5/1990 | Masotta | D8/45 |
| 5,008,970 | A | * | 4/1991 | Tsai | 15/236.01 |
| D367,344 | S | * | 2/1996 | Kruse | D32/49 |
| 5,615,445 | A | | 4/1997 | Kelsay et al. | |
| D389,720 | S | | 1/1998 | Warner et al. | |
| 5,850,663 | A | | 12/1998 | Hardy et al. | |
| 5,920,946 | A | * | 7/1999 | McCarten | 15/236.01 |
| D414,395 | S | | 9/1999 | Panfili | |
| 5,956,799 | A | | 9/1999 | Panaccione et al. | |
| 6,131,290 | A | * | 10/2000 | Chiou | 30/169 |
| D446,437 | S | | 8/2001 | Chen | |
| 6,453,563 | B1 | | 9/2002 | Farland | |
| 6,647,629 | B2 | | 11/2003 | Farland | |
| D486,046 | S | | 2/2004 | Norton | |
| D487,387 | S | | 3/2004 | Chen | |
| 2001/0037534 | A1 | | 11/2001 | Bryan | |
| 2002/0104182 | A1 | * | 8/2002 | Panfili et al. | 15/236.01 |

FOREIGN PATENT DOCUMENTS

| | | | |
|---|---|---|---|
| FR | 2840636 | * | 12/2003 |
| GB | 2 111 575 A | | 7/1983 |

* cited by examiner

*Primary Examiner*—Mark Spisich
(74) *Attorney, Agent, or Firm*—Greer, Burns & Crain, Ltd.; David F. Janci, Esq.; Pradip Sahu, Esq.

(57) ABSTRACT

A taping knife has a web, a working edge, two side edges, and a handle edge opposite the working edge. The handle is connected to the blade to have an angular orientation relative to the working edge of the blade such that the handle is neither parallel nor perpendicular to the blade working edge.

14 Claims, 3 Drawing Sheets

TAPING KNIFE WITH OFFSET HANDLE

BACKGROUND OF THE INVENTION

The present invention relates generally to hand tools and hand tool handles, and more specifically to taping knives for use in finishing wallboard construction.

Taping knives, which have varying blade widths, are used to finish drywall or wallboard construction projects and create a smooth surface between abutting drywall surfaces. In this application, the terms "taping knife" and "taping tool" are considered interchangeable. After drywall boards are secured to the underlying wall supports, a smaller taping knife (e.g. four to six inches) is generally used to apply settable joint compound and drywall tape to the joints formed by the abutting drywall surfaces. At this stage, unseated nails may also be set into wallboard and supporting studs. After the joint compound dries, progressively larger taping knives (e.g. eight to fourteen inches) are used to apply more compound to the joint areas. This step is repeated, with intermittent sanding steps, until the joint is sufficiently flat and smooth.

In the professional world, tools such as these are often used for extended periods of time. Conventional taping knives are frequently designed with ease of manufacturing in mind, rather than ease of use. This design process can produce tools with light weight and hollow handles molded from a hard plastic. Such handles are difficult or uncomfortable to grip adequately and consequently allow the user's hand to slip on the tool, especially when the hand or the knife handle becomes wet.

The handle is generally made to fit comfortably in the hand of an adult male user. Consequently, users with smaller hands may have difficulty maintaining a firm grip on the knife and controlling it as necessary. However, if the handle size of a traditional taping knife were simply reduced, those with average sized hands would no longer be able to properly grip the knife.

Finally, when using conventional taping knives, their configuration requires the hand and wrist to bend at an uncomfortable angle and remain in a prone position for extended periods of time. Moreover, the wrist is forced into a particularly awkward position when using the end of the knife to strike nails or screws protruding from the wall. Over long periods of time, the awkward grip configuration contributes to fatigue, cramping, and general user discomfort.

Consequently, the construction and home repair and home decorating industries, as well as do-it-yourself workers have long felt the need for a well-designed, durable, professional grade tool that reduces stress and fatigue of the user's hand and arm.

BRIEF SUMMARY OF THE INVENTION

The present taping knife responds to the above identified needs felt by construction, home decorating, and home repair professionals, as well as do-it-yourself workers. The present taping knife has a handle with an angular, non-perpendicular orientation relative to the working edge of the taping knife blade. This angular offset allows the knife to be held in a more comfortable position, reducing stress on the wrist and overall fatigue when using the knife to spread joint compound and joint tape and when using the end of the handle as a hammer. The knife also features a tapered handle to allow those with smaller hands to grip the knife more comfortably while still allowing those with average sized hands to maintain a secure grip. Further, the knife has a relatively soft one-piece outer coating. This coating helps to prevent the users hand from slipping while using the tool, even should the tool become wet. This grip provides another degree of comfort to the user, particularly when the tool is in use for an extended time.

More specifically, the present invention provides a taping knife that is designed to have a blade and an ergonomic handle. The knife blade has a web, a working edge, two side edges, and a handle edge opposite the working edge. The handle is connected to the blade to have an angular orientation relative to the working edge of the blade, meaning the handle is neither parallel nor perpendicular to the blade working edge.

DETAILED DESCRIPTION OF THE INVENTION

Figure 1:
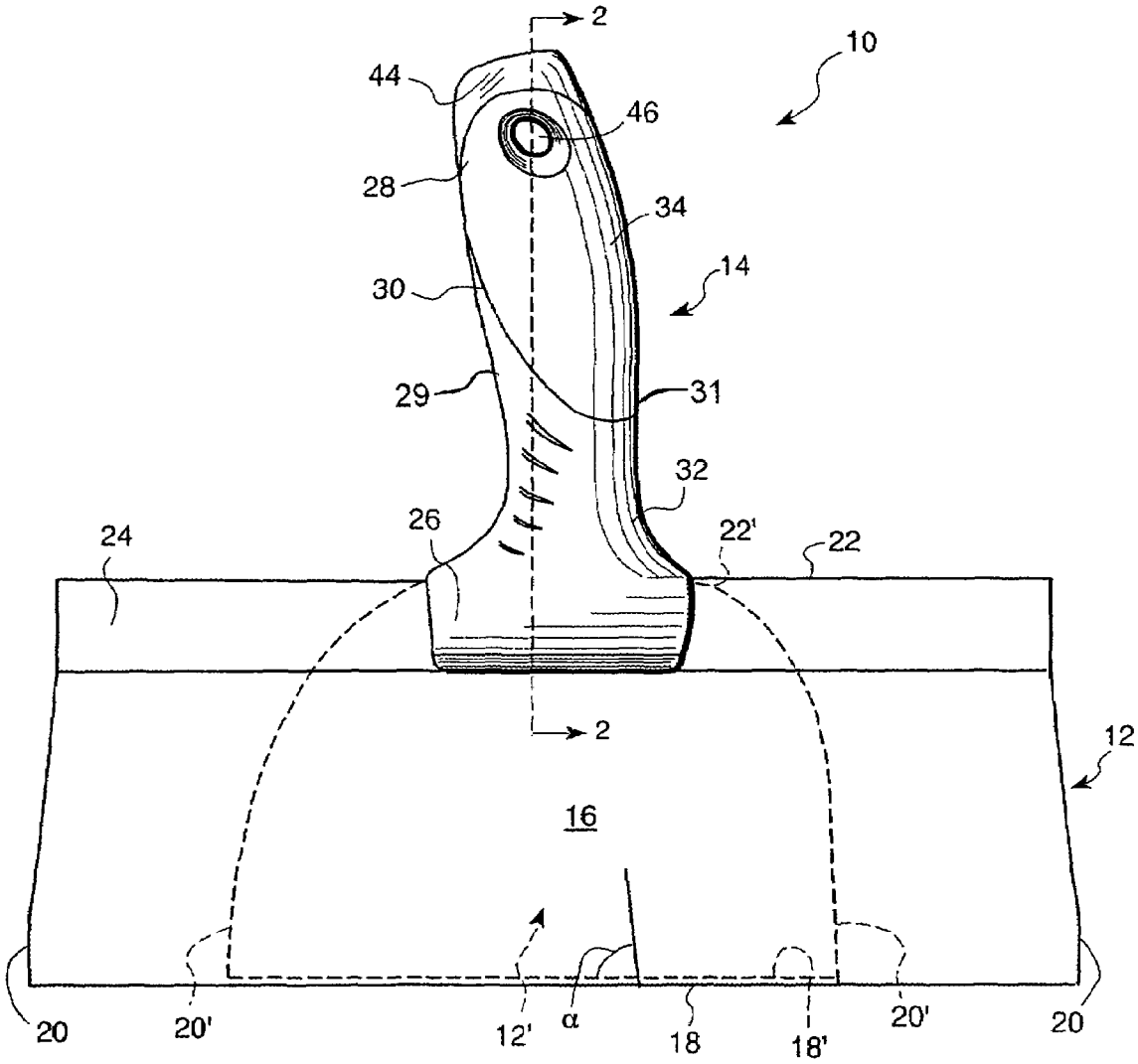
FIG. 1 is a front view of the preferred embodiment of the present taping knife.

Referring now to FIG. 1, the present taping knife is generally designated 10. The knife 10 generally includes a blade 12, 12', and a handle 14.

The taping knife blade 12, 12' is made up of a web 16, a working edge 18, 18', two side edges 20, 20', and a handle edge 22, 22' opposite the working edge. Taping knife blades are preferably thin and flexible, and they typically taper in thickness throughout the portions of the blade 12, 12' with the thickest portion at the handle and the thinnest portion at the end of the blade. The blade 12, 12' is preferably made from blued steel, but other materials exhibiting similar physical characteristics are contemplated.

There are generally two styles of blade that are preferred: a blade 12 (shown in solid lines) eight to fourteen inches wide that has side edges 20 (shown in solid lines) composed of substantially straight segments and a handle edge 22 that is nearly as long as the working edge 18, and a blade 12' (shown in phantom) which is one to possibly eight inches wide, has curving side edges 20' (shown in phantom) and has a handle edge 22' that is much narrower than the working edge 18'. On blades typically eight inches or wider, it is preferred that the blade 12 additionally has a reinforcing backing 24 that extends the length of the handle edge 22 and projects over a portion of the web 16. The reinforcing backing 24 is provided to lend strength to the wider blades, and to address manufacturing issues well known in the art.

Although there are two embodiments represented, one in solid lines and one in phantom, they are extremely similar. For simplicity, only the first embodiment will be discussed. However, differences between the embodiments will be noted.

In the present knife 10, the reinforcing backing 24 is preferably made from aluminum or another different metal than the metal used to make the blade 12. Other metals that exhibit the necessary strength, hardness, weight, and cost characteristics are also contemplated.

The tool handle 14 includes a first end 26 and a second end 28, separated by a middle portion 30. The handle further includes a first side 29 proximal to one of the side edges 20 and a second side 31 proximal to another of the side edges 20, the first and second sides also being separated by the middle portion 30. In addition, the middle portion 30 is further subdivided into a neck portion 32 adjacent to the first end 26, and a body portion 34 adjacent to the second end 28. To complete the general structure of the tool, the handle 14 is preferably attachable to the blade 12 at the center of the handle edge 22.

In the preferred embodiment of the present knife 10, the handle 14 has a generally arcuate shape when viewed from the front or rear. Also, a radial cross section of the handle 14 is substantially elliptical. This overall handle shape is designed to mimic the hand's interior shape, and enhance ergonomic compatibility with the user's hand.

The handle 14 has an angular orientation relative to the working edge 18 meaning, when viewed from the front or rear, the handle 14 is neither perpendicular nor parallel to the working edge 18. An angle $\alpha$ is defined by the offset orientation of the handle 14 relative to the working edge 18. While a variety of angles are contemplated, the preferred angle $\alpha$ varies depending on the width of the blade. For blades that are one to six inches wide, an angular offset for $\alpha$ in the general range of 3°-10° is preferred, and about 5° from perpendicular is most preferred. However, for wider blades, a larger angular offset $\alpha$ is preferable. Because the handle 14 still attaches to the blade 12 at the center of the handle edge 22, the handle's angular orientation causes the second end 28 to be closer to one of the side edges (20, 20') than to the other.

The first end 26 of the handle 14 is configured to be attachable to the blade 12. In the preferred tool 10, the first end 26 extends over at least a portion of the blade's handle edge 22, and onto the web 16. For blades eight to fourteen inches wide, the first end 26 preferably extends the same distance onto the web as the reinforcing backing 24. For blades one to possibly eight inches wide (eight inch knife can be provided with a small rounded blade or a larger angular blade), the first end 26 covers only the portion of the blade 12 adjacent to the handle 14. The extension is preferably formed by injection molding the handle 14 about the blade 12 so that the plastic forms over the handle edge 22.

Also, in the preferred embodiment for all blade sizes, the first end 26 flares laterally outward. This flare causes the first end 26 to be wider than both the neck portion 32 and the body portion 34 of the handle. However, the amount of flare may vary with the width of the blade 12.

Figure 2:
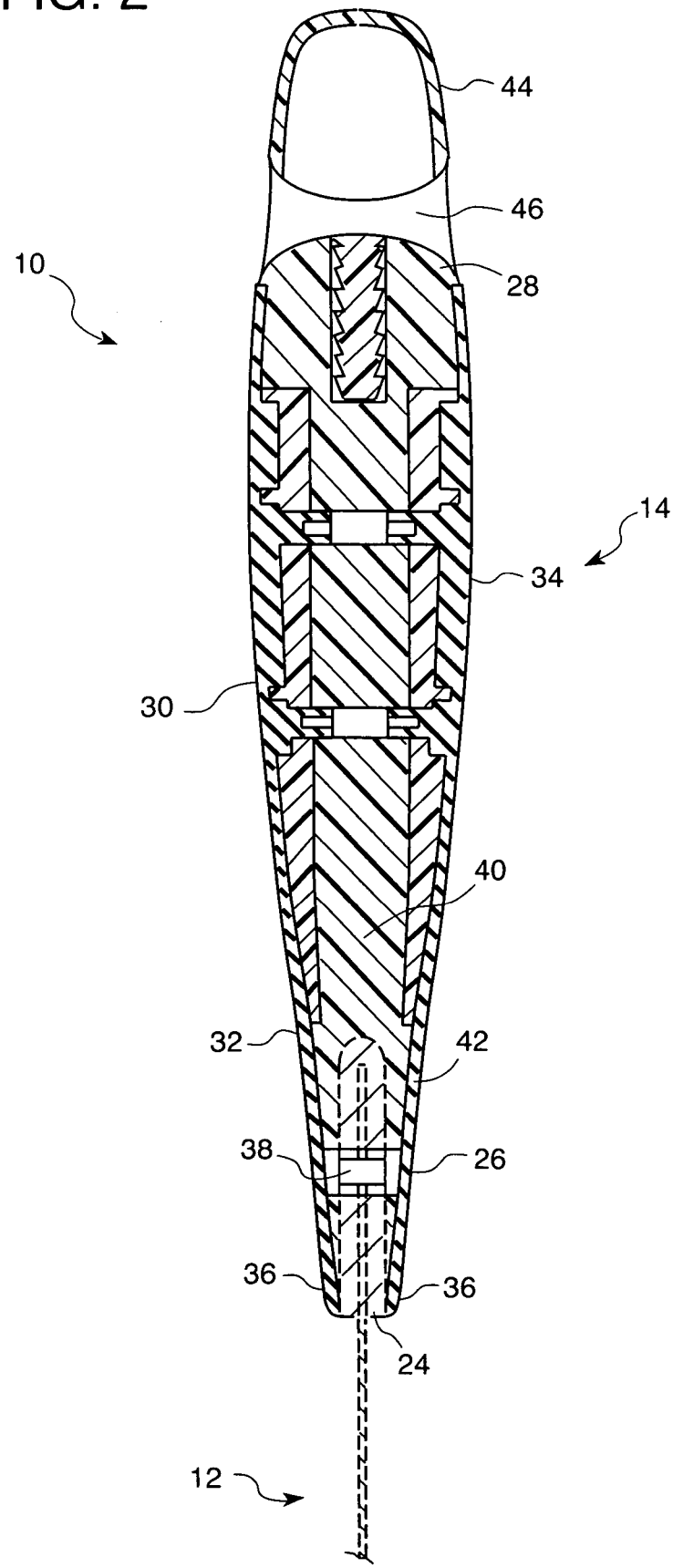
FIG. 2 is a cross-section of the knife taken along the line 2-2 as indicated in FIG. 1, in the direction generally indicated.
Figure 3:
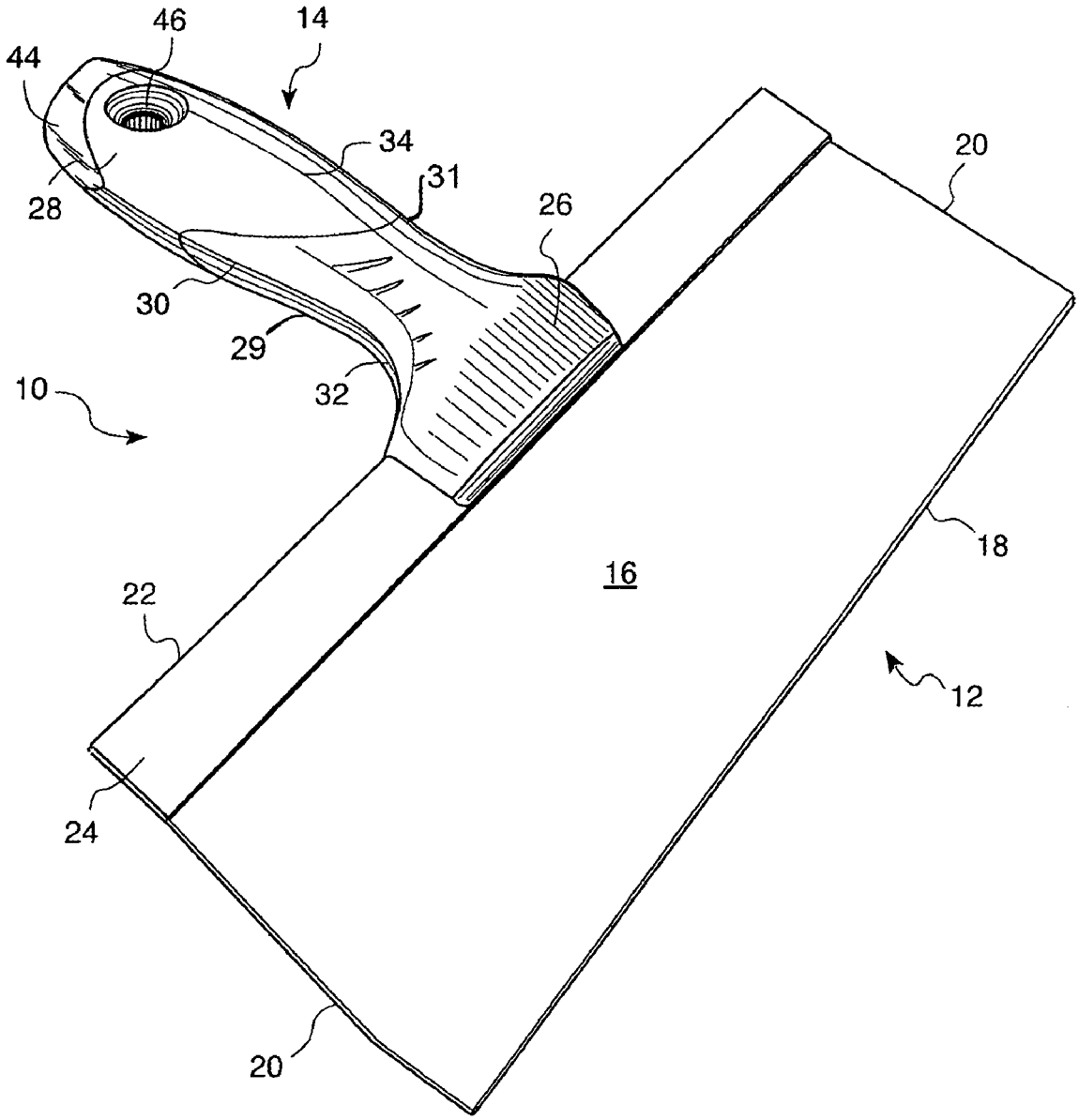
FIG. 3 is a top perspective view of the taping knife of FIG. 1.

As is best seen in FIG. 2, the preferred knife 10 has a first end 26 that includes two lips 36 that narrow in thickness from the second end 28 to the first end 26. An advantage of this configuration is that these lips 36 provide a smooth transition from the handle 14 to the blade 12, and help provide a more comfortable grip for the user.

Another advantage of the configuration of the first end 26 is that it creates a moisture-resistant barrier around a joint 38. This barrier helps prevent water and joint compound from seeping into the joint 38 between the blade 12 and the handle 14. Retention of water, joint compound and the like around the joint 38 is known to lead to corrosion and an eventual weakening of the blade 12 at that point. Thus, it is desirable to prevent as much seepage as possible in the preferred embodiment.

The middle portion 30 of the handle 14 is made up of an inner core 40 and an outer coating 42. In the preferred embodiment, the inner core 40 is made from a relatively hard material, for example a well-known hard thermoplastic material such as polypropylene, polyolefin, or glass filled nylon. Other materials with the desired characteristics of environmental resistance, durability, affordability, and strength are contemplated as well. A solid inner core portion may be overmolded with at least one layer of plastic material to form the inner core 40. However, it is also contemplated that the handle 14 is made of two mating hollow halves fastened to a blade shank, as is well known in the art.

Next, the inner core 40 is surrounded by a softer, more resilient outer coating 42 which makes the tool both easier to hold onto and more comfortable to grip. The softer outer coating 42 is preferably made from any well-known soft, rubber-like thermoplastic material such as Santoprene brand styrene-ethylene-butylene-styrene or polystyrene. These materials are preferred, but other embodiments could utilize various other plastics and rubbers in their construction to provide a resilient grip.

Returning to FIG. 1, the middle portion 30 of the handle 14 is designed for comfort when gripping the knife 10. While the body portion 34 remains wide to provide a grip for average-sized hands, the neck portion 32 tapers inward so that the radial cross-section of the neck portion has the same general shape as that of the body portion, but is smaller in area. The tapered neck portion 32 also allows users with smaller hands to maintain a comfortable grip on the knife 10, and allows for enhanced control of the knife.

In the preferred knife 10, the second end 28 of the handle 14 is provided with a hammer element 44, preferably formed from a relatively harder material to function as a hammer. The hammer element 44 is preferably formed from a metal, but may be made of any material that is hard enough to withstand repeated strikes against a nail or screw head. During manufacturing of the knife 10, the hammer element 44 is either and secured after the handle 14 has been formed, or the handle is molded around the hammer element. The angular orientation of the handle 14 makes the hammer element 44 on the second end 28 easier and more comfortable to use.

In addition, the body portion 34 is provided with a hanger opening 46 to be used for hanging the tool from a hook, peg, or other apparatus when not in use. This opening 46 preferably extends generally radially through the body portion 34 and perpendicular to the plane described by the blade 12. This configuration will allow for most efficient storage when hanging the tool on a wall.

While a particular embodiment of the present taping knife has been described herein, it will be appreciated by those skilled in the art that changes and modifications may be made thereto without departing from the invention in its broader aspects and as set forth in the following claims.

What is claimed is:

1. A taping knife comprising:

a blade having a web, a working edge, two side edges, and a handle edge opposite said working edge; and a handle connected to said blade, said handle having a non-perpendicular, non-parallel, angular orientation relative to said working edge of said blade, said handle having a first side proximal to one of said side edges and a second side proximal to another of said side edges, said first side and said second side each having an arcuate shape, said first side and said second side being non-symmetrical about a central axis passing through said handle, said second side having a greater radius of curvature than said first side, said handle including a first end and a second end separated by a middle portion, said first end extending laterally along said blade a greater distance from said first side than from said second side, said middle portion including a neck portion adjacent to said first end and a body portion adjacent to said second end, said neck portion defined by opposing concave surfaces and said body portion defined by opposing convex surfaces on said first and second sides, a central portion of said body portion having a width that is greater than a width of said neck portion and an end portion of said body portion adjacent said second end, said handle being arranged at an angle in a range of 3-10° relative to said working edge.

2. The knife according to claim 1, wherein said second end of said handle is nearer to one side edge of said blade than to said other side edge of said blade.

3. The knife according to claim 1, wherein said first end includes two lips narrowing in thickness progressing from said second end to said first end.

4. The knife according to claim 1, wherein said second end is provided with a hammer element made from a relatively harder material.

5. The knife according to claim 1, wherein said handle is provided with a hanger opening to be used for hanging the tool.

6. The knife according to claim 5, wherein said hanger opening extends generally radially through said handle.

7. The knife according to claim 1, wherein said handle has an inner core made from a relatively strong, hard material to provide structural integrity to the tool, and a relatively softer outer coating applied over said inner core for facilitating gripping.

8. The knife according to claim 7, wherein said inner core is made of a relatively hard plastic, and said outer coating is made of a relatively softer plastic.

9. The knife according to claim 1, wherein said neck portion tapers so that a radial cross-section of said neck portion has a smaller area than a radial cross section of said body portion.

10. The knife according to claim 1, wherein said first end is attachable to said blade to form a moisture-resistant barrier where said handle and said blade are joined.

11. The knife according to claim 1, wherein said first end flares laterally outward such that said first end is wider than said neck portion and said body portion.

12. The knife according to claim 1, wherein said blade maintains a generally uniform thickness across all portions of the blade.

13. The knife according to claim 1, wherein said handle is attachable to said blade along said handle edge.

14. A taping knife comprising:

a blade having a web, a working edge, two side edges, a handle edge opposite said working edge and a reinforcing backing along the handle edge that extends over a portion of said web of said blade; and a handle connected to said blade, said handle having a non-perpendicular, non-parallel, angular orientation relative to said working edge of said blade, said handle including a first side proximal to one of said side edges, having a first arcuate shape and a second opposing side proximal to another of said side edges, having a second arcuate shape, said first side and said second side being non-symmetrical about a central axis passing through said handle, said second side having a greater radius of curvature than said first side, said handle having a first end and a second end separated by a middle portion, said first end extending laterally along said blade a greater distance from said first side than from said second side, said first end being attachable to said blade to from a moisture-resistant barrier where said handle and said blade are joined and having a length that is substantially the same as a distance said reinforcing backing extends over said web of said blade, said second end including a hammer element made from a relatively harder material, said handle including a neck portion adjacent to said first end and a body portion adjacent to said second end, said neck portion defined by opposing concave surfaces and said body portion defined by opposing convex surfaces on said first and second sides, a central portion of said body portion having a width that is greater than a width of said neck portion and an end portion of said body portion adjacent said second end.

* * * * *